US007367752B2

(12) United States Patent
Price

(10) Patent No.: US 7,367,752 B2
(45) Date of Patent: May 6, 2008

(54) EXTENDED WIDTH RETAINING WALL BLOCK

(75) Inventor: Brian A. Price, Rochester, MN (US)

(73) Assignee: Mortarless Technologies, LLC, Rochester, MN (US)

( * ) Notice: Subject to any disclaimer, the term of this patent is extended or adjusted under 35 U.S.C. 154(b) by 67 days.

(21) Appl. No.: 11/271,223

(22) Filed: Nov. 12, 2005

(65) Prior Publication Data

US 2006/0101770 A1 May 18, 2006

Related U.S. Application Data

(60) Provisional application No. 60/707,496, filed on Aug. 11, 2005, provisional application No. 60/673,946, filed on Apr. 22, 2005, provisional application No. 60/627,360, filed on Nov. 12, 2004.

(51) Int. Cl.
*E04C 2/04* (2006.01)

(52) U.S. Cl. ..... 405/284; 52/603; 52/604; 52/605; 52/609

(58) Field of Classification Search ..... 405/284, 405/286; 52/598, 599, 603–606, 608, 609
See application file for complete search history.

(56) References Cited

U.S. PATENT DOCUMENTS 751,346 A 2/1904 Schall
1,260,024 A 3/1918 Parton
1,526,730 A 2/1925 Zottoli
1,727,362 A 9/1929 Bone
1,762,343 A 6/1930 Munster
1,795,451 A 3/1931 Sharpe
1,816,916 A 8/1931 Sentrop
3,686,873 A 8/1972 Vidal
4,068,482 A 1/1978 Hilfiker
4,123,881 A 11/1978 Muse
4,154,554 A 5/1979 Hilfiker
4,207,718 A 6/1980 Schaaf et al.
4,266,890 A 5/1981 Hilfiker
4,324,508 A 4/1982 Hilfiker et al.
4,343,572 A 8/1982 Hilfiker
4,391,557 A 7/1983 Hilfiker et al.
4,470,728 A 9/1984 Broadbent (Continued)

OTHER PUBLICATIONS

Brochure, Keysystem 1, Retaining Wall System, copyrighted 2000, pp. 1-8.

(Continued)

*Primary Examiner*—Tara L. Mayo
(74) *Attorney, Agent, or Firm*—Patterson, Thuente, Skaar & Christensen, P.A.

(57) ABSTRACT

A retaining wall block having a front surface, a rear surface, side surfaces, a top surface, and a bottom surface. Each side surface comprises a first section, a second section, a third section, and a fourth section, with the sections configured and arranged to allow a plurality of blocks to be arranged in a convex wall structure. The retaining wall block may be combined with one or more pins, which may engage vertically adjacent blocks and which may engage an end of an earth anchor. The retaining wall block may be cast in a mold box whose depth and width are configured and arranged to substantially approximate the depth and width of a standard sized pallet.

19 Claims, 8 Drawing Sheets

U.S. PATENT DOCUMENTS

| | | | |
|---|---|---|---|
| 4,592,678 | A | 6/1986 | McNinch, Jr. et al. |
| 4,909,010 | A | 3/1990 | Gravier |
| 4,914,876 | A | 4/1990 | Forsberg |
| 4,920,712 | A | 5/1990 | Dean, Jr. |
| 4,968,186 | A | 11/1990 | Ogorchock |
| D317,048 | S | 5/1991 | Forsberg |
| 5,044,834 | A | 9/1991 | Janopaul, Jr. |
| 5,046,898 | A | 9/1991 | McKinney |
| 5,064,313 | A | 11/1991 | Risi et al. |
| 5,145,288 | A | 9/1992 | Borcherdt |
| 5,163,261 | A | 11/1992 | O'Neill |
| 5,259,704 | A | 11/1993 | Orgorchock |
| 5,337,527 | A | 8/1994 | Wagenaar |
| 5,451,120 | A | 9/1995 | Martinez-Gonzalez |
| 5,456,554 | A | 10/1995 | Barrett et al. |
| 5,474,405 | A | 12/1995 | Anderson et al. |
| 5,484,235 | A | 1/1996 | Hilfiker et al. |
| 5,505,034 | A | 4/1996 | Dueck |
| 5,511,910 | A | 4/1996 | Scales |
| 5,525,015 | A | 6/1996 | Morimoto et al. |
| 5,540,525 | A | 7/1996 | Miller et al. |
| 5,551,809 | A | 9/1996 | Forsberg |
| 5,622,456 | A | 4/1997 | Risi et al. |
| 5,647,185 | A | 7/1997 | Forlini |
| 5,653,558 | A | 8/1997 | Price |
| 5,673,530 | A | 10/1997 | Bailey, II |
| 5,704,183 | A | 1/1998 | Woolford |
| 5,800,095 | A | 9/1998 | Egan |
| 5,816,749 | A | 10/1998 | Bailey, II |
| 5,823,709 | A | 10/1998 | Maher et al. |
| 5,827,015 | A | 10/1998 | Woolford et al. |
| D403,437 | S | 12/1998 | Risi et al. |
| D405,543 | S | 2/1999 | Shillingburg |
| 5,913,790 | A | 6/1999 | Dawson |
| 5,951,210 | A | 9/1999 | Maguire et al. |
| 6,086,288 | A | 7/2000 | Ruel et al. |
| 6,113,318 | A | 9/2000 | Guth |
| 6,168,353 | B1 | 1/2001 | Price |
| RE37,278 | E | 7/2001 | Forsberg |
| 6,287,054 | B1 | 9/2001 | Egan |
| 6,336,773 | B1 | 1/2002 | Anderson et al. |
| D459,487 | S | 6/2002 | Bott |
| D466,229 | S | 11/2002 | Risi et al. |
| 6,474,036 | B2 | 11/2002 | Martin et al. |
| 6,536,994 | B2 | 3/2003 | Race |
| D479,342 | S | 9/2003 | Dawson |
| 6,615,561 | B2 * | 9/2003 | MacDonald et al. ..... 52/606 |
| 6,622,445 | B1 | 9/2003 | Shillingburg et al. |
| 6,651,401 | B2 | 11/2003 | Price et al. |
| 6,652,197 | B2 | 11/2003 | Shaw |
| D485,371 | S | 1/2004 | Burgess et al. |
| 6,675,547 | B1 | 1/2004 | Golcheh |
| 6,792,731 | B2 | 9/2004 | Bott et al. |
| D497,399 | S | 10/2004 | May et al. |
| 6,808,339 | B2 | 10/2004 | Peterson et al. |
| 6,821,058 | B1 | 11/2004 | Dawson |
| D501,935 | S | 2/2005 | Dawson et al. |
| 7,059,808 | B2 | 6/2006 | Risi |
| 7,096,635 | B2 | 8/2006 | Price et al. |
| D530,832 | S | 10/2006 | Rainey |
| 2005/0016106 | A1 | 1/2005 | Dawson et al. |
| 2006/0110222 | A1 | 5/2006 | Price |
| 2006/0179780 | A1 | 8/2006 | Price |

OTHER PUBLICATIONS

Case Study, Water Application, Keystone Retaining Wall System, Upper Cumberland River Flood Project, copyrighted 2000, pp. 1-4.

Case Study, Governmental Application, Keystone Retaining Wall System, Port of Seattle Terminal #5 & SW Harbor Reclamation, copyrighted 2000, pp. 1-4.

Keystone, Retaining Wall System, *The First to Last*, copyrighted 1997, pp. 1-19.

"Classic" product literature, Rockwood Retaining Walls, 12 pgs., 1997.

International Search Report, 2 pages.

Office Action dated Nov. 30, 2006, 8 pages.

Office Action dated Jun. 6, 2006, 14 pages.

* cited by examiner

EXTENDED WIDTH RETAINING WALL BLOCK

This application claims priority from Provisional Application Ser. No. 60/627,360 filed Nov. 12, 2004, Provisional Application Ser. No. 60/673,946 filed Apr. 22, 2005, and Provisional Application Ser. No. 60/707,496 filed Aug. 11, 2005.

FIELD OF THE INVENTION

This invention relates generally to retaining walls. More particularly, the present invention relates to manufactured blocks that are used to construct mortarless retaining walls.

BACKGROUND OF THE INVENTION

Retaining walls can be both functional and decorative and range from small gardening applications to large-scale construction projects. Such walls are typically used to facilitate the formation of horizontal surface areas by providing a generally vertical barrier behind which backfill may be deposited. Such walls can also used reduce erosion and slumping in embankments. Retaining walls can be constructed of a variety of materials having a variety of shapes. Some retaining walls have been constructed from wood timbers, while others have been constructed from rocks such as limestone of fieldstones. Still others have been constructed of manufactured concrete blocks. A drawback to existing concrete retaining wall blocks is that production, shipping, and installation is limited due to their size.

SUMMARY OF THE INVENTION

A retaining wall block that may be used with an earth anchor is disclosed. Generally, the retaining wall block comprises a front surface, a rear surface, side surfaces, a top surface, and a bottom surface. More particularly, each side surface comprises a first section, a second section, a third section, and a fourth section, with the second section forming a shoulder against which a projection of a vertically adjacent block may abut, and with the fourth section configured to allow a plurality of blocks to be arranged in a convex configuration.

In accordance with one aspect of the present invention, the bottom surface is provided with front and rear projections, with the front projection including a contact edge that is configured and arranged to position the block relative to a lower course of blocks when it is placed thereon. The rear projection has dual functions, one of which is to position the block when it is placed on a lower course of blocks that are arranged in a convex course, the other of which is to facilitate stacking on a pallet for shipping.

The above block may be provided with a core hole that extends through the block between the top and bottom surfaces. The core hole reduces the amount of material needed to form the block and greatly reduces the weight thereof, resulting in a block that is easier to manufacture and manipulate.

The above block may be provided with a plurality of core holes that extend through the block between the top and bottom surfaces. The core holes are separated from each other by a web or core support that serves to strengthen the block. Again, the core holes reduce the amount of material needed to form the block and reduce the weight thereof.

Alternatively, the above block may be formed without any core holes between the top and bottom surfaces. This block has greater strength and weight than the previously discussed cored blocks and is particularly suited for use in lower courses and where pressure exerted by backfill is greater than what would normally be expected.

Generally, the aforementioned blocks have substantially the same height, front surface width, and depth, preferably ranging around 4 to 9 inches (10 to 23 cm), 20 to 24 inches (50 to 60 cm), and 8 to 12 inches (20 to 30), respectively, and more preferably around 8 inches (20 cm), 24 inches (60 cm), and 9 inches (23 cm), respectively. The size and location of the shoulder formed by the second sections can vary, and this can change the distance between the third sections of the sides, and the lengths of the third sections from about 1 to 3 inches 2.54 to 8 cm).

In accordance with a further aspect of the invention, the bottom surface of a block is provided with a single projection that is configured and arranged to abut the shoulders of vertically adjacent blocks when a plurality of blocks are arranged to form a multi-course wall structure.

As will be understood, the above retaining wall blocks may be used with earth anchor grids such as geo-grid or steel ladders. The aforementioned embodiment may also be arranged in a plurality of configurations, such as linear and serpentine walls, or enclosures.

In an alternative embodiment, the projection(s) on the bottom surface of the blocks may be omitted and blocks combined with one or more intermediate members to form an engagement system that constrainingly positions vertically adjacent blocks in a wall structure.

The intermediate members may take several different forms; for example, as a pin that is received in apertures at the top and bottom surfaces of vertically adjacent blocks, as a clip that attaches to the block such that a portion thereof extends downwardly therefrom relative to the bottom surface, or as a clip that attaches to the block such that a portion thereof extends upwardly therefrom relative to the top surface.

The above projectionless blocks may be provided with one or a plurality of core holes that extend through the block between the top and bottom surfaces, with the plurality of core holes separated from each other by a web or stem that serves to strengthen the block. As will be appreciated, the plurality of core holes need not extend completely through the blocks. For example, the core holes may form upwardly extending recesses that terminate short of the top surface.

At will be appreciated that the projectionless blocks used in conjunction with the engagement system may also be used in conjunction with earth anchors such as metal grids or lattices, and plastic grids or lattices such as geo-grid. And, while it is possible to merely position a portion of an earth anchor between adjacent courses of blocks and rely on the weight of the blocks and frictional forces to maintain the positioning of the blocks relative to the earth anchor, it is preferred to operatively connect the blocks to an earth anchor using one or more of the intermediate members.

It will be appreciated that the front surfaces of the aforementioned blocks may be provided with decorative and/or aesthetic finishes. For example, the front surfaces may be planar, angular, prismatic, or curvilinear, and have a wide variety of finishes. In addition, the front surface of a single block may be provided with alpha-numeric characters, or with simulative decorative characters or objects in bas or alto relief.

In accordance with an additional aspect of the present invention there is provided a mold box, with the mold box comprising opposed side and end walls which, when combined with a pallet, form a cavity. Preferably, the mold box is configured to be used on standard sized pallets.

Additional advantages and features of the invention will appear more fully from the following description, made in conjunction with the accompanying drawings wherein like reference characters refer to the same or similar parts throughout the several views.

DETAILED DESCRIPTION

Figure 1:
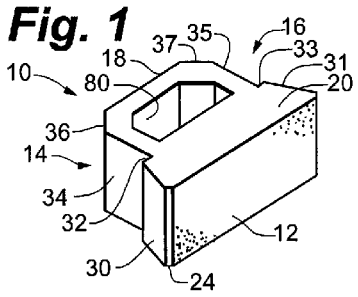
FIG. 1 is a perspective view of a preferred embodiment of a block of the present invention, looking down to reveal the details of the top and front surfaces.
Figure 2:
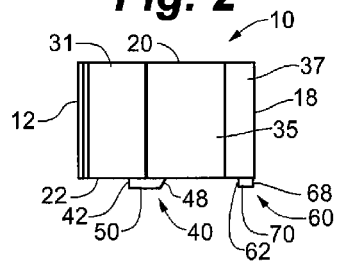
FIG. 2 is a side elevational view of the block of FIG. 1.
Figure 3:
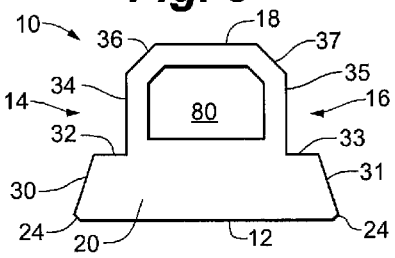
FIG. 3 is a top plan view of the block of FIG. 1.
Figure 4:
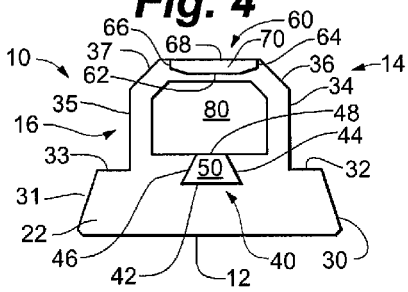
FIG. 4 is a bottom plan view of the block of FIG. 1.

An embodiment of a block 10 of the present invention is shown in FIGS. 1-4. The block 10 comprises a front surface 12, side surfaces 14 and 16, a rear surface 18, a top surface 20 and a bottom surface 22. Although front surface 12, as depicted, features a straight face with beveled edges 24, it is understood that it other surface configurations and finishes may be used.

Generally, each side surface 14 and 16 comprises a plurality of sections that are angled with respect to each other. More specifically, side surface 14 comprises a first section 30, a second section 32, a third section 34 and a fourth section 36, and side surface 16 comprises a first section 31, a second section 33, a third section 35, and a fourth section 37. Since the sections of side surfaces 14 and 16 are mirror images of each other, only side surface 14 need be discussed in detail. As can be seen, the first section 30 extends from the front surface 12 towards the rear of the block and terminates at the intersection with the second section 32. The second section 32 extends towards the center of the block and terminates at the intersection with the third section 34. Continuing on, the third section 34 extends towards the rear of the block and terminates at the intersection with the fourth section 36, and the fourth section 36 extends toward the rear of the block and terminates at the intersection with the rear surface 18 thereof. Note that the first section of each side is configured so that when a plurality of blocks are arranged in a convex course so that first sections of adjacent blocks are in confronting relation, the size of the vertical joint formed thereby is minimized. Note that the second section of each side forms a generally laterally extending shoulder that is configured to abuttingly receive a projection of vertically adjacent block. Note that the second section of each side is positioned outwardly beyond the lateral extent of the rear surface. And note that the fourth section of each side is configured so that when a plurality of blocks are arranged in a convex course the fourth sections of adjacent blocks permit the first sections of adjacent blocks to be positioned adjacent to each other in a close fitting relation.

The bottom surface 22 comprises a front projection 40 and a rear projection 60. More specifically, the front projection 40 comprises a contact edge 42, side edges 44 and 46, a back edge 48 and a bottom 50. The contact edge 42 is configured and arranged so that when a block is positioned upon a lower course of blocks and slid forward, the contact edge 42 abuts against at least one shoulder of a block therebelow. This positions the block relative to the course of blocks therebelow and prevents forward movement due to pressure exerted from backfill material. Note that the side edges 44 and 46 are configured so that they do not interfere with the third sections of blocks when a plurality of blocks is arranged in a convex course.

The rear projection 60 of the bottom surface 22 has a contact edge 62, side edges 64 and 66, a back edge 68 and a bottom 70. When a plurality of blocks are arranged in convex courses, the contact edge 62 may serve to further position the block relative to the course of blocks therebelow and prevent forward movement due to pressure exerted from backfill material be coming into an abutting relation with the rear surface of a block therebelow. As with the front projection, the contact edge 62 of the rear projection is configured and arranged so that when a block is positioned upon a convexly shaped lower course of blocks and slid forward, the contact edge 62 may abut against at least one rear surface of a block therebelow. Another function of the rear projection is to facilitate stacking onto a pallet for shipping.

The block 10 includes a through hole 80 that extends from the top surface 20 to the bottom surface 22. As will be appreciated, the through hole 80 serves several functions. It reduces the amount of material needed to form the block and it reduces overall weight of the block 10, which makes it easier to lift and manipulate.

Figure 5:
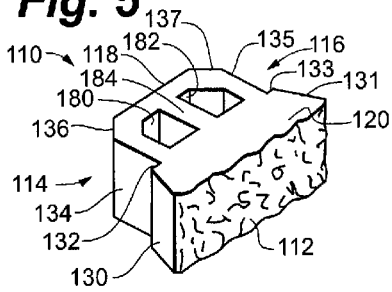
FIG. 5 is a perspective view of another embodiment of a block of the present invention, looking down to reveal the details of the top and front surfaces.
Figure 6:
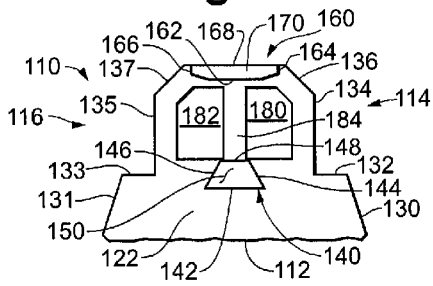
FIG. 6 is a bottom plan view of the block of FIG. 5.

Another embodiment of a block 110 of the present invention is shown in FIGS. 5-6. As with the previously described embodiment, this block 110 comprises a front surface 112, side surfaces 114 and 116, a rear surface 118, a top surface 120 and a bottom surface 122. Although front surface 112, as depicted, features a weathered or roughened face, it is understood that it other surface configurations and finishes may be used.

Each side surface 114 and 116 of block 110 comprises a plurality of sections that are angled with respect to each other. As depicted, side surface 114 comprises a first section 130, a second section 132, a third section 134 and a fourth section 136, while side surface 116 comprises a first section 131, a second section 133, a third section 135, and a fourth section 137. Since the sections of side surfaces 114 and 116 are mirror images of each other, only side surface 114 need be discussed in detail. More specifically, the first section 130 extends from the front surface 112 towards the rear of the block and terminates at the intersection with the second section 132, the second section 132 extends towards the center of the block and terminates at the intersection with the third section 134, the third section 134 extends towards the rear of the block and terminates at the intersection with the fourth section 136, and the fourth section 136 extends toward the rear of the block and terminates at the intersection with the rear surface 118 thereof.

As with the previously described embodiment, the first section of each side is configured so that when a plurality of blocks are arranged in a convex course so that first sections of adjacent blocks are in confronting relation, the size of the vertical joint formed thereby is minimized. Similarly, the second section of each side forms a shoulder that is configured to abuttingly receive a projection of vertically adjacent block. In addition, the fourth section of each side is configured so that when a plurality of blocks are arranged in a convex course the fourth sections of adjacent blocks permit the first sections of adjacent blocks to be positioned adjacent to each other in a close fitting relation.

The bottom surface 122 of block 110 comprises a front projection 140 and a rear projection 160. More specifically, the front projection 140 comprises a contact edge 142, side edges 144 and 146, a back edge 148 and a bottom 150. The contact edge 142 is configured and arranged so that when a block is positioned upon a lower course of blocks and slid forward, the contact edge 142 abuts against at least one shoulder of a block therebelow. This positions the block relative to the next lower course of blocks therebelow and prevents forward movement due to pressure exerted from backfill material. The side edges 144 and 146 are configured so that they do not interfere with the third sections of blocks when a plurality of blocks is arranged in a convex course.

The rear projection 160 of the bottom surface 122 has a contact edge 162, side edges 164 and 166, a back edge 168 and a bottom 170. When a plurality of blocks are arranged in convex courses, the contact edge 162 may serve to further position the block relative to the course of blocks therebelow and prevent forward movement due to pressure exerted from backfill material be coming into an abutting relation with the rear surface of a block therebelow. As with the front projection, the contact edge 162 of the rear projection 160 is configured and arranged so that when a block is positioned upon a convexly shaped lower course of blocks and slid forward, the contact edge 162 may abut against at least one rear surface of a block therebelow. Another function of the rear projection is to facilitate stacking onto a pallet for shipping.

Figure 7:
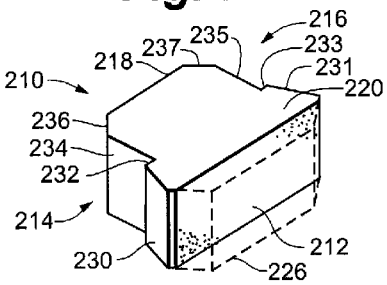
FIG. 7 is a perspective view of another embodiment of a block of the present invention, looking down to reveal the details of the top and front surfaces.
Figure 8:
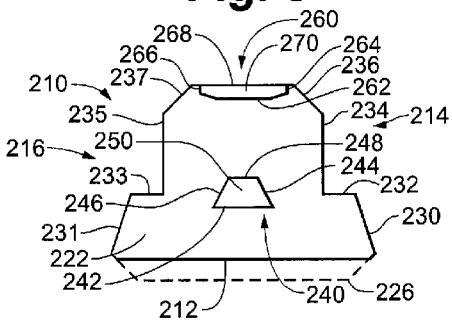
FIG. 8 is a bottom plan view of the block of FIG. 7.
Figure 9:
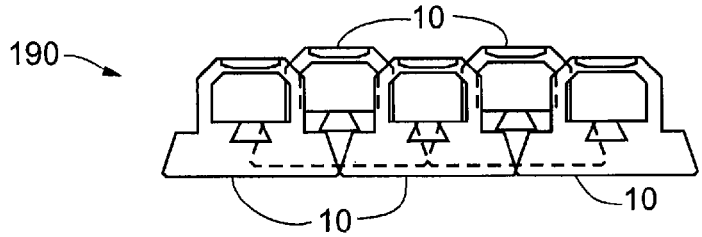
FIG. 9 is a bottom plan view of a segment of a linear wall formed by a plurality of blocks of FIG. 1, with the lower course of blocks shown in black and the upper course of blocks shown in phantom.

The block 110 differs from the previously described embodiment in that instead of having a single through hole, this embodiment includes two through holes 180, 182, that extend from the top surface 120 to the bottom surface 122. The through holes 180, 182 are separated from each other by a web 184, which serves to strengthen the block. As will be appreciated, the through holes 180 and 182 serve several functions. They reduce the amount of material needed to form the block and they reduce overall weight of the block 110, which makes it easier to lift and manipulate Another embodiment of the present invention is shown in FIGS. 7-8. As with the previously described embodiments, this block 210 comprises a front surface 212, side surfaces 214 and 216, a rear surface 218, a top surface 220 and a bottom surface 222. Although front surface 212, as depicted, features a straight, it is understood that it other surface configurations and finishes may be used. For example, the front surface may be provided with a plurality of facets 226 (shown in dashed lines).

Each side surface 214 and 216 comprises a plurality of sections that are angled with respect to each other. As depicted, side surface 214 comprises a first section 230, a second section 232, a third section 234 and a fourth section 236, while side surface 216 comprises a first section 231, a second section 233, a third section 235, and a fourth section 237. Since the sections of side surfaces 214 and 216 are mirror images of each other, only side surface 214 need be discussed in detail. More specifically, the first section 230 extends from the front surface 212 towards the rear of the block and terminates at the intersection with the second section 232, the second section 232 extends towards the center of the block and terminates at the intersection with the third section 234, the third section 234 extends towards the rear of the block and terminates at the intersection with the fourth section 236, and the fourth section 236 extends toward the rear of the block and terminates at the intersection with the rear surface 218 thereof.

As with the previously described embodiments, the first section of each side is configured so that when a plurality of blocks are arranged in a convex course so that first sections of adjacent blocks are in confronting relation, the size of the vertical joint formed thereby is minimized. Similarly, the second section of each side forms a shoulder that is configured to abuttingly receive a projection of vertically adjacent block. In addition, the fourth section of each side is configured so that when a plurality of blocks are arranged in a convex course the fourth sections of adjacent blocks permit the first sections of adjacent blocks to be positioned adjacent to each other in a close fitting relation.

The bottom surface 222 of block 210 comprises a front projection 240 and a rear projection 260. More specifically, the front projection 240 comprises a contact edge 242, side edges 244 and 246, a back edge 248 and a bottom 250. The contact edge 242 is configured and arranged so that when a block is positioned upon a lower course of blocks and slid forward, the contact edge 242 abuts against at least one shoulder of a block therebelow. This positions the block relative to the next lower course of blocks therebelow and prevents forward movement due to pressure exerted from backfill material. The side edges 244 and 246 are configured so that they do not interfere with the third sections of blocks when a plurality of blocks is arranged in a convex course.

The rear projection 260 of the bottom surface 222 has a contact edge 262, side edges 264 and 266, a back edge 268 and a bottom 270. When a plurality of blocks are arranged in convex courses, the contact edge 262 may serve to further position the block relative to the course of blocks therebelow and prevent forward movement due to pressure exerted from backfill material be coming into an abutting relation with the rear surface of a block therebelow. As with the front projection, the contact edge 262 of the rear projection 260 is configured and arranged so that when a block is positioned upon a convexly shaped lower course of blocks and slid forward, the contact edge 262 may abut against at least one rear surface of a block therebelow. Another function of the rear projection is to facilitate stacking onto a pallet for shipping.

The block 210 differs from the previously described embodiments in that instead of having a single or multiple through holes, this embodiment has a substantially solid and continuous top surface 220. As will be appreciated, this embodiment is comparatively robust and may be used in applications where force exerted by backfill is expected to be relatively high.

Examples of the types of wall structures that may be constructed using above described blocks are depicted in FIGS. 9-12. The wall structure 190 of FIG. 9 comprises two courses of blocks are linearly arranged, with the bottom most course of blocks depicted in black, and with the second, uppermost course depicted in phantom. The wall structure 192 of FIG. 10, which comprises a plurality of courses in side elevation, also shows the use of an earth anchor or grid 194 therewith. It will be understood that the particular type of earth anchor used with the above described blocks is up to the discretion of a user. For example, a user may use a metallic lattice earth anchor, or a flexible plastic earth anchor. The wall structures 196, 198 of FIGS. 11 and 12, respectively depict arrangements that are generally concave and generally convex. It will be understood that foregoing wall structures may be constructed with any of the above described embodiments, or with combinations thereof.

Another embodiment of the present invention is shown in FIGS. 13-16. With this embodiment, the shape of the block 310 is wider and shallower compared to the previously described embodiments. This enables the block to be formed with existing molding machinery in a more efficient manner. And, because the block has a larger front surface than conventional blocks, it takes fewer blocks to form a wall structure. It will be appreciated that this has the effect of speeding up construction. Preferably, the block has a width in the range of about 18 to 38 inches (46 to 96 cm), a height in the range of about 4 to 12 inches (10 to 30 cm), and a depth in the range of about 4 to 24 inches (10 to 60 cm). More preferably, the block has a width in the range of about 20 to 24 inches (50 to 60 cm), a height in the range of about 4 to 9 inches (10 to 23 cm), and a depth in the range of about 9 to 12 inches 23 to 30). Expressed alternatively, the block may have a volume in the range of about 288 to 1,800 cubic inches (4,680 to 28,800 cc) or a weight in the range of about 18 to 150 pounds (8 to 68 kg). Preferably, though, the width and depth dimensions (taken along the x and z directions in a three-dimensional coordinate system) are designed to be wholly divisible into the dimensions of existing mold pallets. Thus, for example, it is envisioned that two blocks could be cast in a mold box resting upon a pallet having a width of around 24 inches (60 cm) and a depth of around 18 inches (46 cm).

As with the previously described embodiments, this block 310 comprises a front surface 312, side surfaces 314 and 316, a rear surface 318, a top surface 320 and a bottom surface 322. Although front surface 312, as depicted, features a straight, it is understood that it other surface configurations and finishes may be used.

Each side surface 314 and 316 comprises a plurality of sections that are angled with respect to each other. As depicted, side surface 314 comprises a first section 330, a second section 332, a third section 334 and a fourth section 336, while side surface 316 comprises a first section 331, a second section 333, a third section 335, and a fourth section 337. Since the sections of side surfaces 314 and 316 are mirror images of each other, only side surface 314 need be discussed in detail. More specifically, the first section 330 extends from the front surface 312 towards the rear of the block and terminates at the intersection with the second section 332, the second section 332 extends towards the center of the block and terminates at the intersection with the third section 334, the third section 334 extends towards the rear of the block and terminates at the intersection with the fourth section 336, and the fourth section 336 extends toward the rear of the block and terminates at the intersection with the rear surface 318 thereof.

As with the previously described embodiments, the first section of each side is configured so that when a plurality of blocks are arranged in a convex course so that first sections of adjacent blocks are in confronting relation, the size of the vertical joint formed thereby is minimized. Similarly, each second section forms a shoulder that is configured to abuttingly receive a projection of vertically adjacent block. Note that each second section extends outwardly beyond the lateral extent of the rear surface of the block. In addition, each fourth section is configured so that when a plurality of blocks are arranged in a convex course the fourth sections of adjacent blocks permit the first sections of adjacent blocks to be positioned adjacent to each other in a close fitting relation.

The bottom surface 322 comprises a downwardly depending projection 340 comprising a contact edge 342, side edges 344 and 346, a back edge 348 and a bottom 350. The contact edge 342 is configured and arranged so that when a block is positioned upon a lower course of blocks and slid forward, the contact edge 342 abuts against at least one shoulder of a block therebelow. This positions the block relative to the next lower course of blocks therebelow and prevents forward movement due to pressure exerted from backfill material. The side edges 344 and 346 are configured so that they do not interfere with the third sections of blocks when a plurality of blocks is arranged in a convex course.

The block 310 is similar to one of the above described embodiments in that it includes two through holes 380 and 382, which extend from the top surface 320 to the bottom surface 322. The through holes 380, 382 are separated from each other by a web 384, which serves to strengthen the block. As will be appreciated, the through holes 380 and 382 serve several functions. They reduce the amount of material needed to form the block and they reduce overall weight of the block 310, which increases the facing area-to-block weight ratio, and which makes it easier to lift and manipulate. Because the weight of the block is comparable to the weight of prior art blocks, it will be appreciated that it takes fewer blocks and less time to construct a wall with the present invention that it would take build to build a similarly sized wall using prior art blocks.

Examples of the types of wall structures that may be constructed using above described blocks are depicted in FIGS. 17-20. The wall structure 390 of FIG. 17 comprises two courses of blocks are linearly arranged, with the bottom most course of blocks depicted in black, and with the second, uppermost course depicted in phantom. The wall structure 392 of FIG. 18, which comprises a plurality of courses in side elevation, also shows the use of an earth anchor or grid 394 therewith. It will be understood that the particular type of earth anchor used with the above described blocks is up to the discretion of a user. For example, a user may use a metallic lattice earth anchor, or a flexible plastic earth anchor. The wall structures 396 and 398 of FIGS. 19 and 20, respectively, depict arrangements that are generally concave and generally convex. It will be understood that foregoing wall structures may be constructed with any of the above described embodiments, or with combinations thereof.

Another embodiment of a block of the present invention is shown in FIGS. 21-26. This block 410 is similar to the block of FIGS. 13-16 and preferably has a width in the range of about 18 to 38 inches (46 to 96 cm), a height in the range of about 4 to 12 inches (10 to 30 cm), and a depth in the range of about 4 to 24 inches (10 to 60 cm). More preferably, the block has a width in the range of about 20 to 24 inches (50 to 60 cm), a height in the range of about 4 to 9 inches (10 to 23 cm), and a depth in the range of about 9 to 12 inches 23 to 30). Expressed alternatively, the block may have a volume in the range of about 288 to 1,800 cubic inches (4,680 to 28,800 cc) or a weight in the range of about 18 to 150 pounds (8 to 68 kg). Preferably, though, the width and depth dimensions (taken along the x and z directions in a three-dimensional coordinate system) are designed to be wholly divisible into the dimensions of existing mold pallets. Thus, for example, it is envisioned that two blocks could be cast in a mold box resting upon a pallet having a width of around 24 inches (60 cm) and a depth of around 18 inches (46 cm).

As with the previously described embodiments, block 410 comprises a front surface 412, side surfaces 414 and 416, a rear surface 418, a top surface 420 and a bottom surface 422. Although front surface 412, as depicted, is substantially planar, it is understood that it other surface configurations and finishes may be used.

Each side surface 414 and 416 comprises a plurality of sections that are angled with respect to each other. As depicted, side surface 414 comprises a first section 430, a second section 432, a third section 434 and a fourth section 436, while side surface 416 comprises a first section 431, a second section 433, a third section 435, and a fourth section 437. Since the sections of side surfaces 414 and 416 are mirror images of each other, only side surface 414 need be discussed in detail. More specifically, the first section 430 extends from the front surface 412 towards the rear of the block and terminates at the intersection with the second section 432, the second section 432 extends towards the center of the block and terminates at the intersection with the third section 434, the third section 434 extends towards the rear of the block and terminates at the intersection with the fourth section 436, and the fourth section 436 extends toward the rear of the block and terminates at the intersection with the rear surface 418 thereof.

The side surfaces 414, 416 are configured so that when a plurality of blocks are arranged in a convex course so that first sections 430, 431 of adjacent blocks are in confronting relation, the size of the vertical joint formed thereby is minimized. Thus, the rear surface 418 is about one-half to two-thirds the width as the front surface 412. As will be appreciated, this configuration reduces the amount of material needed to manufacture the block, which reduces the overall weight of the block and makes it easier to lift and manipulate.

Figure 21:
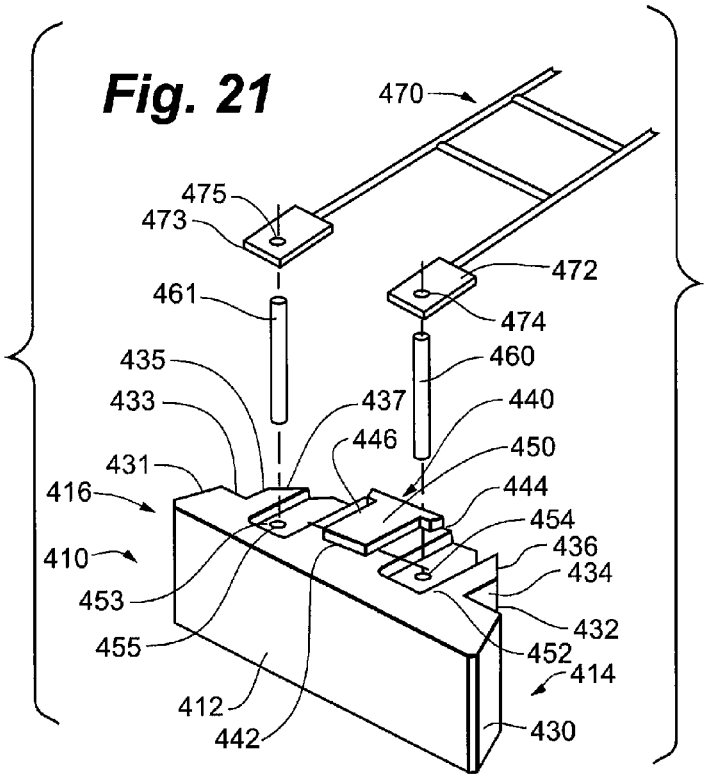
FIG. 21 is a perspective bottom view of an alternative block embodiment in combination with one or more intermediate pin members that engage attachment members of an earth anchor.
Figure 22:
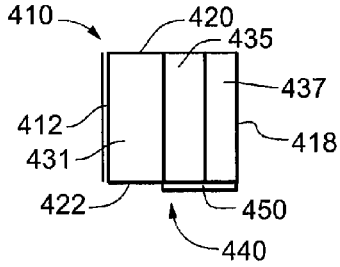
FIG. 22 is a side elevational view of the block of FIG. 21.
Figure 25:
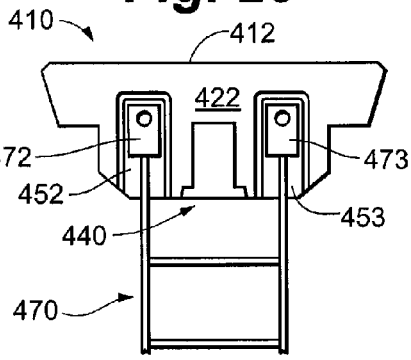
FIG. 25 is a bottom plan view of the block of FIG. 21 in combination with an earth anchor.

The top surface 420 comprises a plurality of apertures 454, 455, which may extend towards the bottom of the block and which are sized to receive members or pins, 460 and 461 (see, FIGS. 21 and 25). The bottom surface 422 comprises a downwardly depending projection 440 comprising a contact edge 442, side edges 444 and 446, a back edge 448 and a bottom 450. The contact edge 442 is configured and arranged so that when a block is positioned upon a lower course of blocks and slid forward, the contact edge 442 abuts against at least one shoulder of a block therebelow. This positions the block relative to the next lower course of blocks therebelow and prevents forward movement due to pressure exerted from backfill material. The side edges 444 and 446 are configured so that they do not interfere with the third sections of blocks when a plurality of blocks is arranged in a convex course.

The bottom surface 422 also comprises a plurality of channels 452, 453, which extend from the rear surface 418 towards the front surface 412 of the block 410. Preferably apertures 454 and 455 are in communication with channels 452 and 453. As depicted in FIGS. 21 and 25, the channels 452 and 453 are configured to receive attachment members 472 and 473 of an earth anchor 470. The attachment members 472 and 473 are provided with apertures 474 and 475, which are configured to admit pins 460 and 461. As will be understood, when a plurality of blocks 410 are positioned in vertically adjacent courses to form a structure, the attachment members 472 and 473 will be constrained by the pins and blocks themselves.

Apertures 454 and 455 enable the pins to constrainingly position blocks in more than two vertically adjacent courses in a wall structure. It will be further appreciated that apertures 425 and 427 may be substantially vertical or rearwardly angled to enable wall structures constructed therewith to be substantially vertical or have an upwardly receding slope, or batter. It will be appreciated that with pins that extend between two or more courses of blocks, the downwardly depending projection 440 may be omitted, if desired.

Figure 10:
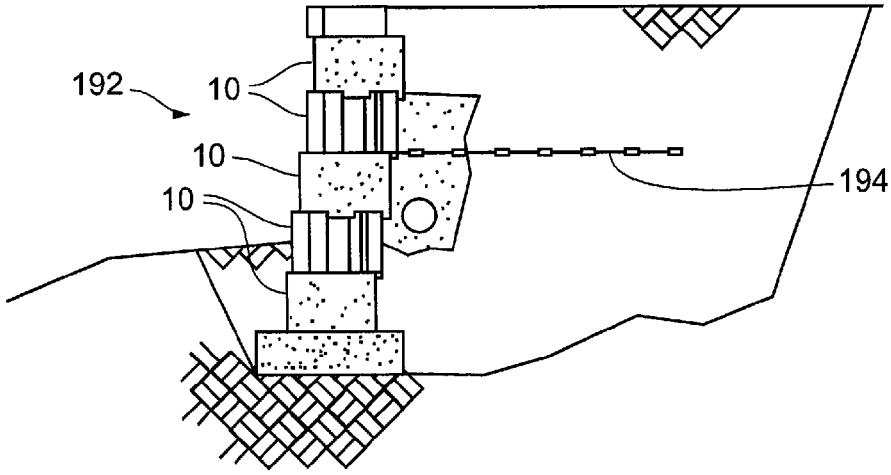
FIG. 10 is a side elevational view of a wall formed by a plurality of blocks of FIG. 1.
Figure 11:
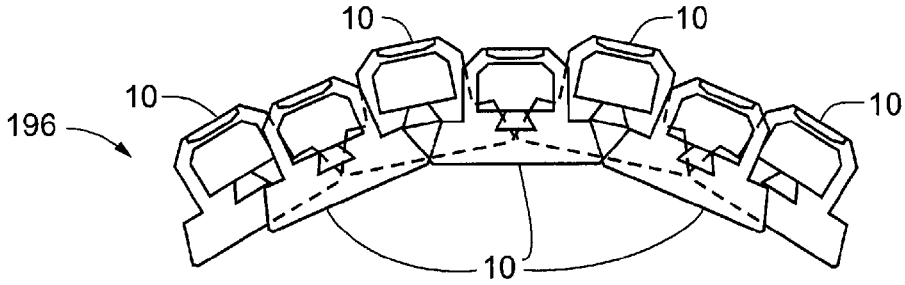
FIG. 11 is a bottom plan view of a segment of a concave wall formed by a plurality of blocks of FIG. 1, with the lower course of blocks shown in black and the upper course of blocks shown in phantom.
Figure 12:
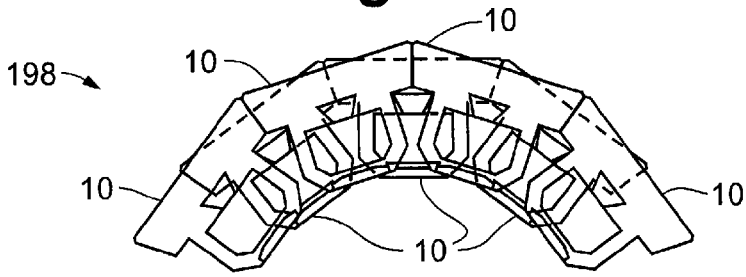
FIG. 12 is a bottom plan view of a segment of a convex wall formed by a plurality of blocks of FIG. 1, with the lower course of blocks shown in black and the upper course of blocks shown in phantom.
Figure 13:
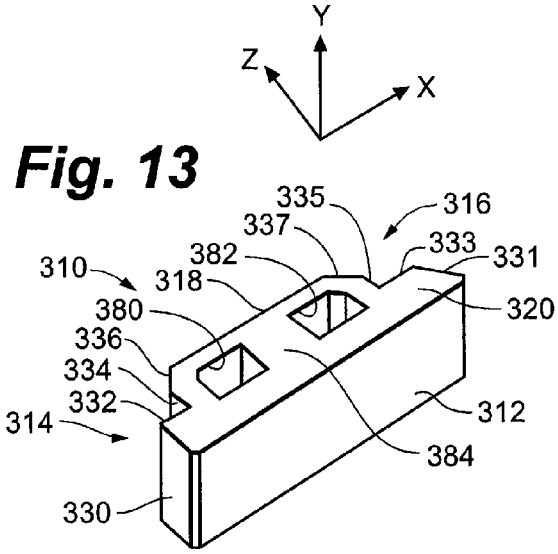
FIG. 13 is a perspective view of a another embodiment of a block of the present invention, looking down to reveal the details of the top and front surfaces.
Figure 14:
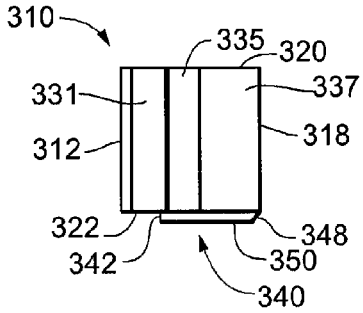
FIG. 14 is a side elevational view of the block of FIG. 13.
Figure 15:
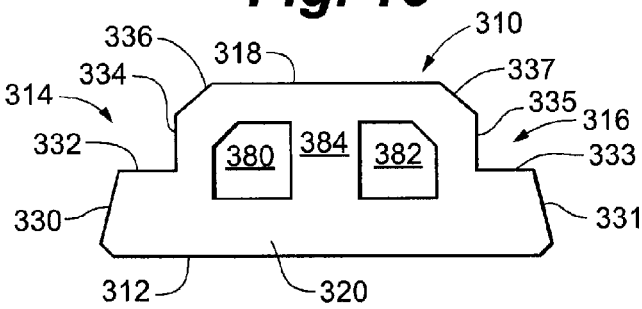
FIG. 15 is a top plan view of the block of FIG. 13.
Figure 16:
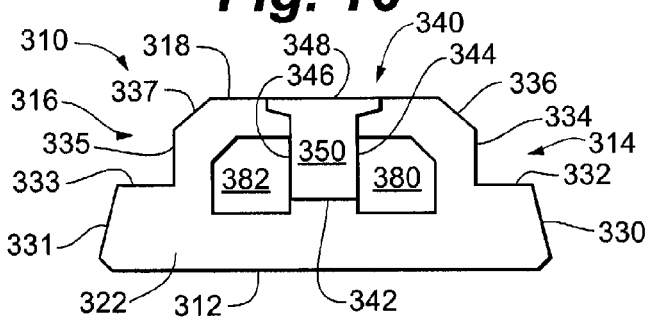
FIG. 16 is a bottom plan view of the block of FIG. 13.
Figure 17:
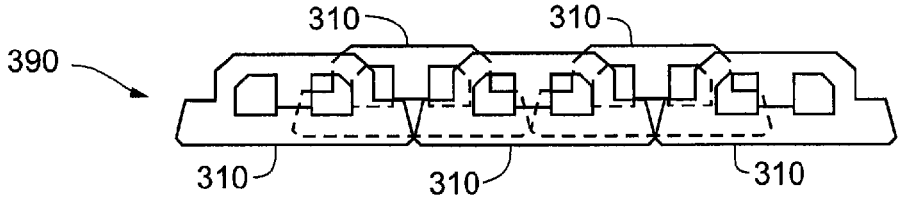
FIG. 17 is a bottom plan view of a segment of a linear wall formed by a plurality of blocks of FIG. 13, with the lower course of blocks shown in black and the upper course of blocks shown in phantom.
Figure 18:
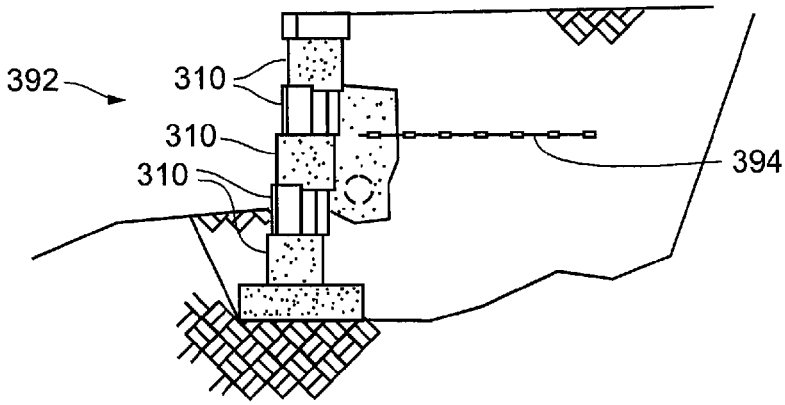
FIG. 18 is a side elevational view of a wall formed by a plurality of blocks of FIG. 13.
Figure 19:
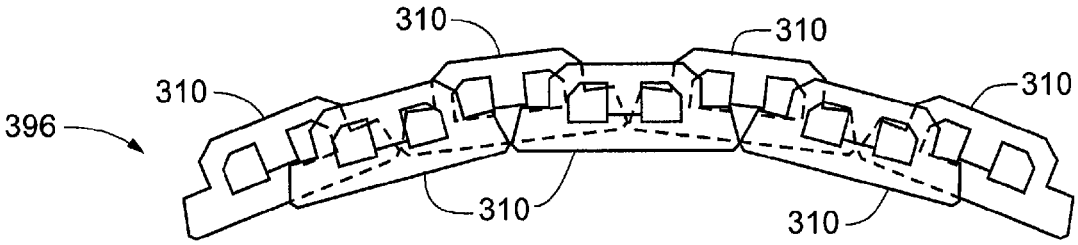
FIG. 19 is a bottom plan view of a segment of a concave wall formed by a plurality of blocks of FIG. 13 with the lower course of blocks shown in black and the upper course of blocks shown in phantom.
Figure 20:
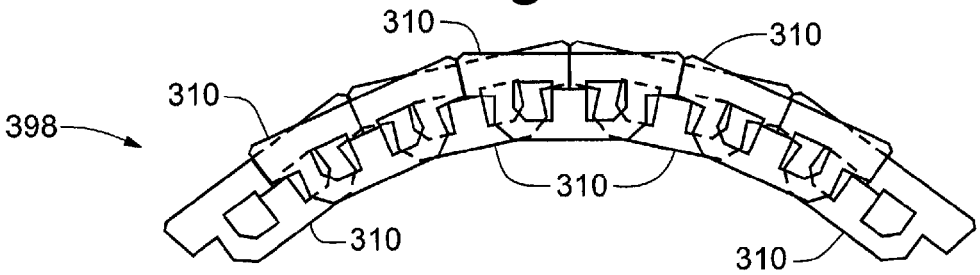
FIG. 20 is a bottom plan view of a segment of a convex wall formed by a plurality of blocks of FIG. 13, with the lower course of blocks shown in black and the upper course of blocks shown in phantom.
Figure 26:
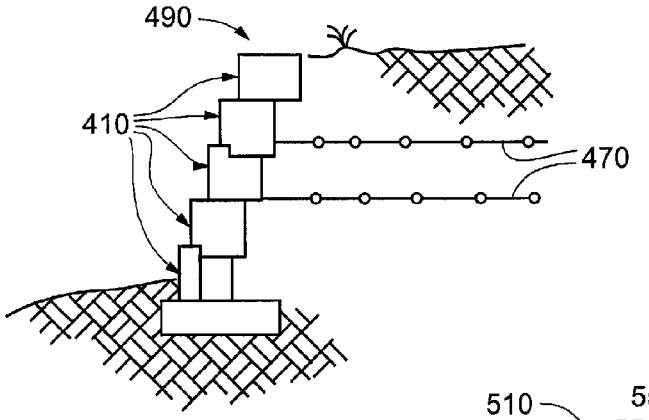
FIG. 26 is a side elevational view of a wall formed by the engagement system of FIG. 21 in combination with earth anchors.

A wall structure that may be constructed using above described blocks is depicted in FIG. 26. Here, the wall structure 490, comprising a plurality of blocks 410 in a plurality of courses, is depicted in side elevation. As with FIGS. 10 and 18, FIG. 26 shows the use of at least one earth anchor or grid 470. Note that the earth anchor 470 may be operatively connected to the wall structure 490 by pins 460 and 461 which extend between adjacent courses and engage the attachment members 472 and 473. It will be understood that the particular type of earth anchor used with the above described blocks and pins are up to the discretion of a user. For example, a metallic lattice earth anchor or a flexible plastic mesh earth anchor.

Figure 27:
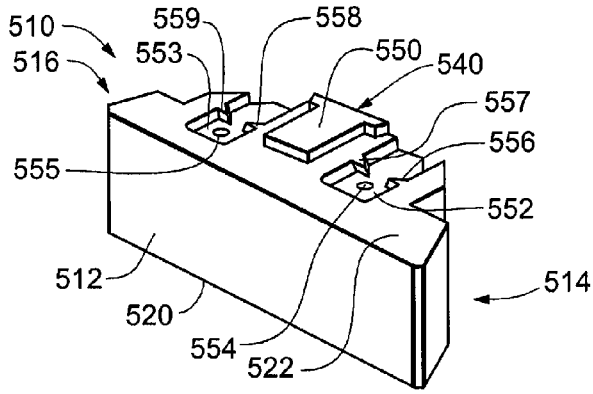
FIG. 27 is an alternative embodiment of a connection point between the block of FIG. 21 and an earth anchor.
Figure 28:
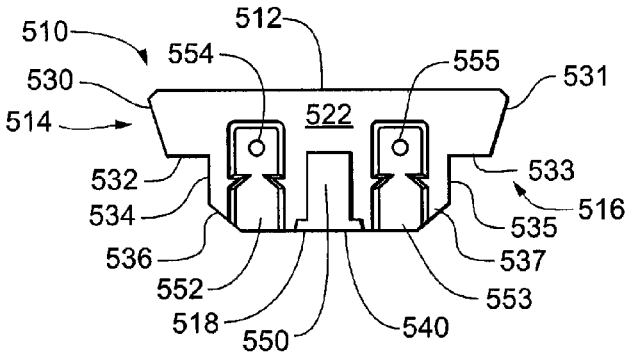
FIG. 28 is a bottom plan view of the block of FIG. 27.
Figure 29:
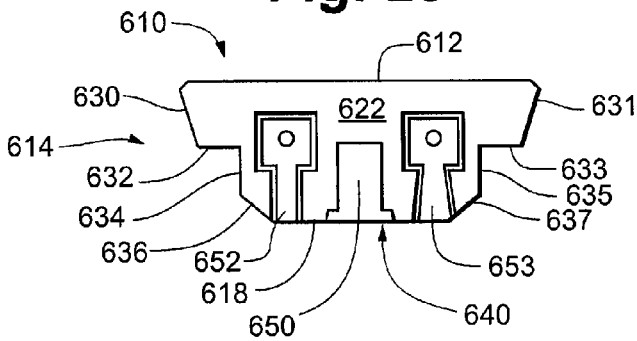
FIG. 29 is a bottom plan view of the block of FIG. 21 with alternative connection points for earth anchors.

Alternative embodiments of block 410 are depicted in FIGS. 27-29. As with the previously described embodiments, blocks 510 and 610 comprise front surfaces 512, 612, side surfaces 514, 516, and 614, 616, rear surfaces 518, 618, top surfaces 520, 620, and bottom surfaces 522, 622.

Each side surface 514, 516, and 614, 616 comprises a plurality of sections that are angled with respect to each other. As depicted, side surfaces 514, 516 comprise first sections 530, 630, second sections 532, 632, third sections 534, 634 and fourth sections 536, 636, while side surfaces 516 and 616 comprise first sections 531, 631, second sections 533, 633, third sections 535, 635, and fourth sections 537, 637. Since the sections of side surfaces 514, 516, and 614, 616 are similar to previously described side surfaces they need not be discussed here in detail.

Figure 23:
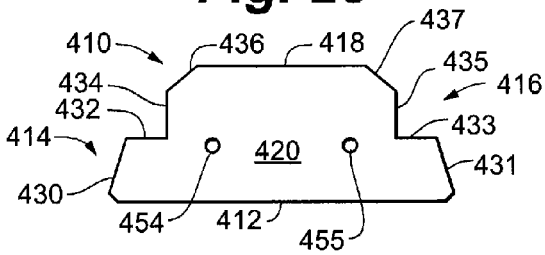
FIG. 23 is a top plan view of the block of FIG. 21.
Figure 24:
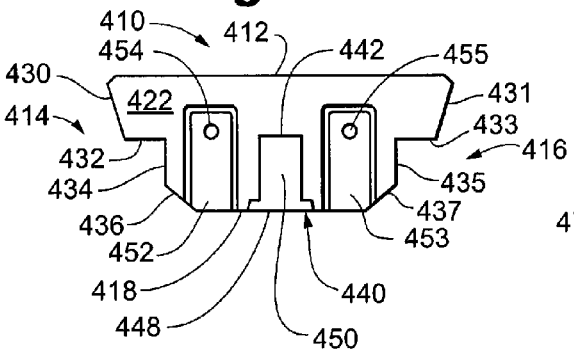
FIG. 24 is a bottom plan view of the block of FIG. 21.

The top surfaces 520 and 620 are identical to the top surface of block 410 shown in FIG. 23 and need not be discussed here in detail. However, the bottom surfaces 522, 622 differ than the bottom surface of block 410 in that they are provided with alternative channel configurations. In FIGS. 27-28, channels 552 and 553 are provided with opposing stops 556, 557, and 558, 559, which form constrictions. The stops are configured to prevent rearward movement of attachment members 472 and 473 of earth anchor 470 (see, FIG. 21). As will be appreciated, such channels permit blocks 510 and 610 to be operatively connected to earth anchors with or without the use of pins. It will also be appreciated that the channels may take many other forms. For example, in FIG. 29, channel 652 has an enlarged portion and a thinned portion, while channel 653 has an enlarged portion and a flared portion.

Another embodiment of a block of the present invention is shown in FIGS. 30-34. With the exception of the omission a downwardly depending projection, block 710 is similar to the block of FIGS. 13-16 and preferably has a width in the range of about 18 to 38 inches (46 to 96 cm), a height in the range of about 4 to 12 inches (10 to 30 cm), and a depth in the range of about 4 to 24 inches (10 to 60 cm). More preferably, the block has a width in the range of about 20 to 24 inches (50 to 60 cm), a height in the range of about 4 to 9 inches (10 to 23 cm), and a depth in the range of about 9 to 12 inches 23 to 30). Expressed alternatively, the block may have a volume in the range of about 288 to 1,800 cubic inches (4,680 to 28,800 cc) or a weight in the range of about 18 to 150 pounds (8 to 68 kg). Preferably, though, the width and depth dimensions (taken along the x and z directions in a three-dimensional coordinate system) are designed to be wholly divisible into the dimensions of existing mold pallets. Thus, for example, it is envisioned that two blocks could be cast in a mold box resting upon a pallet having a width of around 24 inches (60 cm) and a depth of around 18 inches (46 cm).

As with the previously described embodiments, block 710 comprises a front surface 712, side surfaces 714 and 716, a rear surface 718, a top surface 720 and a bottom surface 722. Although front surface 712, as depicted, is substantially planar, it is understood that it other surface configurations and finishes may be used.

Each side surface 714 and 716 comprises a plurality of sections that are angled with respect to each other. As depicted, side surface 714 comprises a first section 730, a second section 732, a third section 734 and a fourth section 736, while side surface 716 comprises a first section 731, a second section 733, a third section 735, and a fourth section 737. Since the sections of side surface 714 and 716 are mirror images of each other, only side surface 714 need be discussed in detail. More specifically, the first section 730 extends from the front surface 712 towards the rear of the block and terminates at the intersection with the second section 732, the second section 732 extends towards the center of the block and terminates at the intersection with the third section 734, the third section 734 extends towards the rear of the block and terminates at the intersection with the fourth section 736, and the fourth section 736 extends toward the rear of the block and terminates at the intersection with the rear surface 718 thereof.

As with the previously described embodiments, the side surfaces 714, 716 are configured so that when a plurality of blocks are arranged in a convex course so that first sections 730, 731 of adjacent blocks are in confronting relation, the size of the vertical joint formed thereby is minimized. Thus, the rear surface 718 is about one-half to two-thirds the width as the front surface 712. As will be appreciated, this configuration reduces the amount of material needed to manufacture the block, which reduces the overall weight of the block and makes it easier to lift and manipulate.

Figure 30:
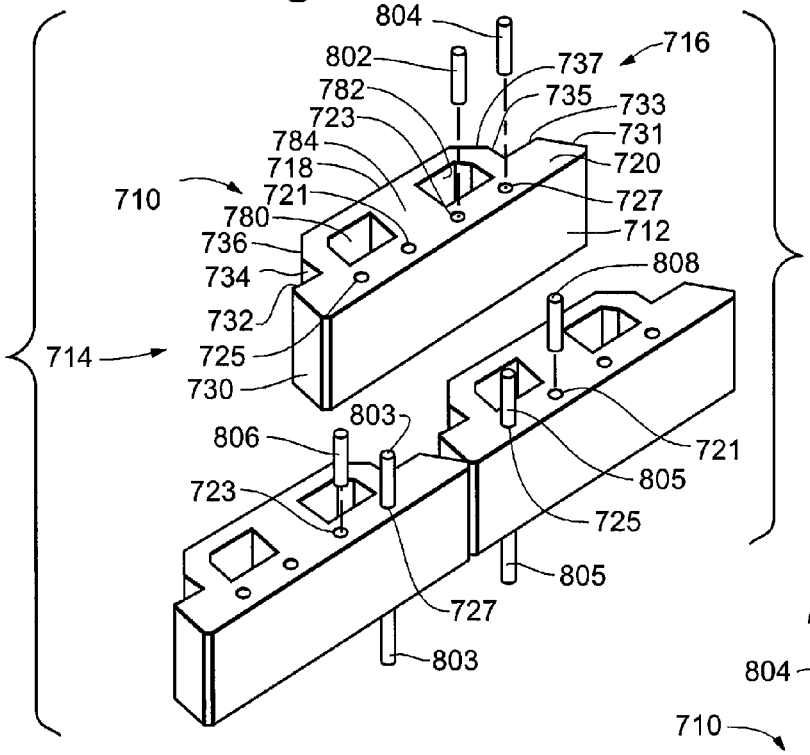
FIG. 30 is an alternative block embodiment in combination with one or more intermediate members that form an engagement system in a wall structure, wherein a block operatively engages one or more vertically adjacent blocks by one or more pins.
Figure 31:
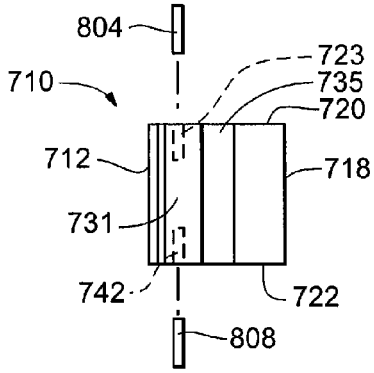
FIG. 31 is a side elevational view of the engagement system of FIG. 30.
Figure 32:
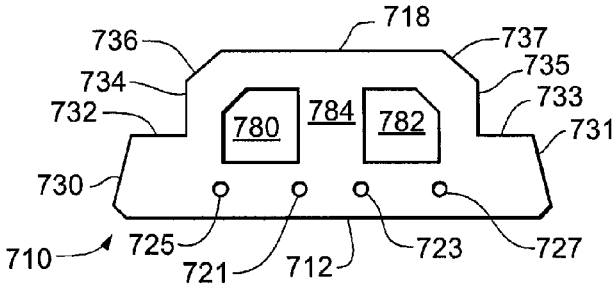
FIG. 32 is a top plan view of the block of FIG. 30.
Figure 33:
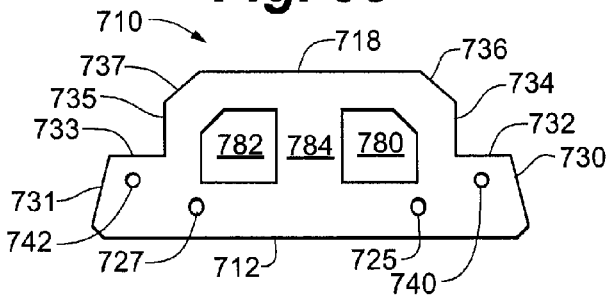
FIG. 33 is a bottom plan view of the block of FIG. 30.

The top surface 720 comprises a plurality of apertures 721, 723, which extend partially towards the bottom of the block and which are sized to receive lower portions of intermediate members or pins, 802 and 804 (see, FIGS. 30-32). The bottom surface 722 comprises a plurality of corresponding apertures 740, 742, which extend partially towards the top of the block and which are sized to receive upper portions of pins 806 and 808 (see, FIGS. 30, 31, and 33) so that two vertically adjacent blocks may be constrainingly positioned in a wall structure.

The top surface may also comprise apertures 725 and 727, which may extend to the bottom surface of the block as shown in FIG. 30, so that pins 803 and 805, which have a length greater than the height of the block, may be used therewith. For example, a pin may extend above the top surface, below the bottom surface, or above and below the top and bottom surfaces. As will be appreciated, apertures 725 and 727 enable the engagement system to constrainingly position blocks more than two vertically adjacent courses in a wall structure. It will be further appreciated that apertures 725 and 727 may be substantially vertical or rearwardly angled to enable wall structures constructed therewith to be substantially vertical or have an upwardly receding slope, or batter.

Block 710 is similar to block 310 in that it may include two through holes 780 and 782, which extend from the top surface 720 to the bottom surface 722. The through holes 780, 782 are separated from each other by a web 784, which serves to strengthen the block. As will be appreciated, the through holes 780 and 782 serve several functions. They reduce the amount of material needed to form the block and they reduce overall weight of the block 710, which makes it easier to lift and manipulate Alternatively, block 710 may be provided with recesses that extend upwardly from the bottom surface, and which stop short of the top surface (not shown).

Figure 34:
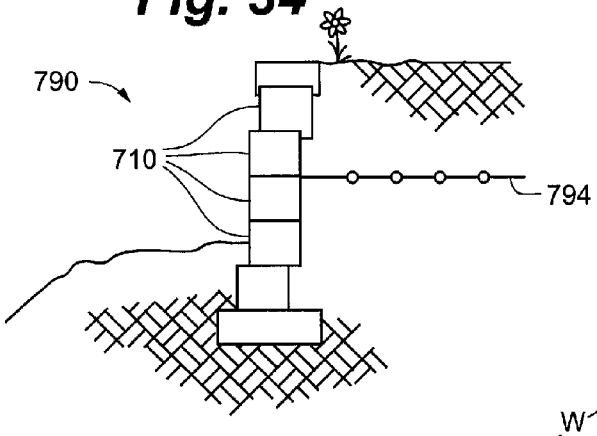
FIG. 34 is a side elevational view of a wall formed by a the engagement system of FIG. 30 in combination with an earth anchor.

A wall structure that may be constructed using above described blocks is depicted in FIG. 34. Here, the wall structure 790, comprising a plurality of blocks 710 in a plurality of courses, is depicted in side elevation. As with FIGS. 10 and 18, FIG. 34 shows the use of an earth anchor or grid 794. Note that the earth anchor 794 may be operatively connected to the wall structure 790 by looping it over one or more of the above described pins. It will be understood that the particular type of earth anchor used with the above described blocks is up to the discretion of a user. For example, a metallic lattice earth anchor or a flexible plastic earth anchor.

Figure 35:
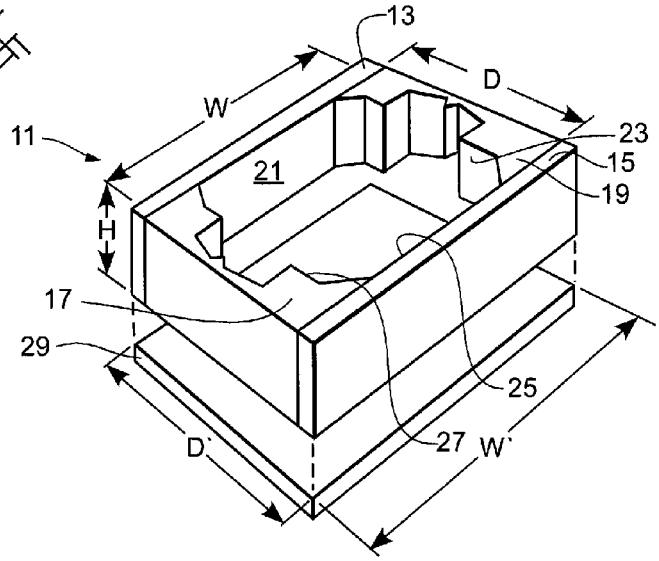
FIG. 35 is a perspective view of a mold box used to form the blocks of the present invention.
Figure 36:
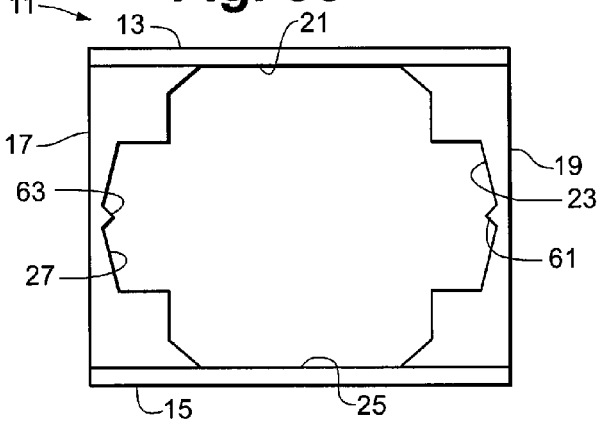
FIG. 36 is a plan view of the mold box of FIG. 35.

In accordance with an additional aspect of the present invention there is provided a mold box in combination with a pallet. As shown in FIGS. 35 and 36, the mold box 11 comprises end walls 13, 15, and side walls 17, 19, which are connected to each other in a conventional manner to define the interior of the mold box 11. When the mold box 11 is positioned upon a pallet 29, the mold box 11 and pallet 29 form a cavity defined by interior surfaces 21, 23, 25, and 27. That is, the cavity has a depth D defined by surfaces 21 and 25, a width W defined by surfaces 23 and 27, and a height H. Note that the depth and width dimensions are substantially the same as the depth D' and width W' dimensions of pallet 29. The height H is preferably around 9 inches (23 cm). As will be appreciated, the similarity in dimensions permits the mold and pallet to be used more efficiently. In this instance, the mold box is configured and arranged to be used in conjunction with a standard sized pallet having preferred nominal dimensions of about 18 inches (46 cm) by 24 inches (61 cm). It will be understood, however, that other standard sized pallets may also be used.

Figure 37:
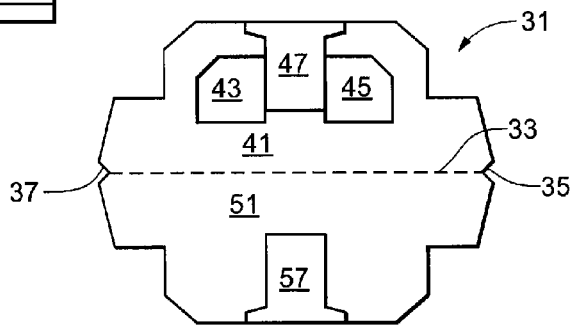
FIG. 37 is a plan view of a block formed by the mold box of FIG. 35 prior to splitting into two blocks.

An example of casting that may be produced by the above mold is shown in bottom plan view at FIG. 37. Here the casting or slug 31 includes a transverse splitting groove 33 (shown in dashed lines), and side splitting grooves 35 and 37. When the casting 31 is split along the splitting grooves, two blocks 41 and 51 are formed. Block 41 includes cores 43, 45, and a projection 47, while block 51 is solid and includes only projection 57. Note that blocks 41 and 51 are examples of different types of blocks that may be produced using different stripper shoes (not shown), and it is understood that both blocks may be cored or solid, if desired. Preferably, though, the blocks produced by the mold box, pallet, and associated stripper shoe will be partially or completely cored so that the blocks produced thereby will have a weight in the range of about 25 to 125 pounds (11 to 57 kg), which can be managed by one person.

In situations where it might be desirable to produce blocks without a split or roughened front surface, it will be understood that the mold box may be provided with a divider plate (not shown) that extends between projections 61 and 63 of side walls 19 and 17, respectively.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. A retaining wall block comprising:

a front surface, a rear surface spaced apart from the front surface, side surfaces, a top surface, and a bottom surface;

wherein the side surfaces each comprise a plurality of sections that are angled with respect to each other, a first one of the plurality of sections forming a laterally extending, rearwardly facing shoulder extending generally parallel to the rear surface and substantially parallel to the front surface, a second one of the plurality of sections disposed adjacent and intersecting the front surface, the shoulders extending outwardly beyond a lateral extent of the rear surface;

the bottom surface comprising at least one projection configured and arranged such that when the second section of one of the side surfaces is engaged with a side surface of a laterally adjacent block in a multiple course wall structure, a contact edge of the projection abuttingly engages a shoulder of a vertically adjacent block; and the bottom surface defining a channel extending from the rear surface toward the front surface, and an aperture extending into the block from the channel.

2. The retaining wall block of claim 1, in combination with a pin, wherein the pin is received in the aperture.

3. The retaining wall block of claim 1, in combination with an earth anchor, wherein an end portion of the earth anchor is received within the channel.

4. The retaining wall block of claim 3, wherein the channel constrainingly receives the end portion of the earth anchor such that the earth anchor is inhibited from being pulled rearwardly out of contact with the channel.

5. The retaining wall block of claim 1, wherein the channel comprises non-parallel side walls.

6. The retaining wall block of claim 5, wherein the channel side walls are continuous.

7. The retaining wall block of claim 1, wherein the channel comprises an enlarged portion and a constricted portion.

8. The retaining wall block of claim 7, wherein the enlarged portion and the constricted portion are connected by continuous side walls.

9. The retaining wall block of claim 1, wherein the contact edge of the projection is parallel to the shoulders and the front surface.

10. The retaining wall block of claim 1, wherein the rear surface has a width that is between one-half and two-thirds of a width of the front surface.

11. The retaining wall block of claim 10, wherein the width of the front surface is between 18 and 36 inches.

12. The retaining wall block of claim 10, wherein the width of the front surface is between 22 and 24 inches.

13. A retaining wall block in combination with a pin and an earth anchor, the block comprising:

a front surface, a rear surface spaced apart from the front surface, side surfaces, a top surface, and a bottom surface;

wherein the side surfaces each comprise a plurality of sections that are angled with respect to each other, a first one of the plurality of sections forming a laterally extending, rearwardly facing shoulder extending generally parallel to the rear surface and substantially parallel to the front surface, a second one of the plurality of sections disposed adjacent and intersecting the front surface, the shoulders extending outwardly beyond a lateral extent of the rear surface;

the bottom surface comprising at least one projection configured and arranged such that when the second section of one of the side surfaces is engaged with a side surface of a laterally adjacent block in a multiple course wall structure, a contact edge of the projection abuttingly engages a shoulder of a vertically adjacent block;

the bottom surface defining a channel extending from the rear surface toward the front surface, and an aperture extending into the block from the channel; and wherein an end portion of the earth anchor is received within the channel; and wherein the pin is received within the aperture and a complementary aperture in the end portion of the earth anchor.

14. The combination of claim 13, wherein the channel constrainingly receives the end portion of the earth anchor such that the earth anchor is prevented from being pulled rearwardly out of contact with the channel.

15. The combination of claim 13, further comprising geogrid connected to the earth anchor.

16. A retaining wall block comprising, a front surface, a rear surface spaced apart from the front surface, side surfaces, a top surface, and a bottom surface;

wherein the side surfaces each comprise a plurality of sections that are angled with respect to each other, a first one of the plurality of sections forming a laterally extending, rearwardly facing shoulder extending generally parallel to the rear surface and substantially parallel to the front surface, a second one of the plurality of sections disposed adjacent and intersecting the front surface, the shoulders extending outwardly beyond a lateral extent of the rear surface;

the bottom surface comprising a first means for constraining the block relative to a vertically adjacent block; and the bottom surface comprising a second means for constraining the block relative to the vertically adjacent block.

17. A method of interlocking retaining wall blocks in vertically adjacent courses, the method comprising the steps of:

stacking a first block on top of a second block, each block comprising:

a front surface, a rear surface spaced apart from the front surface, side surfaces, a top surface, and a bottom surface;

wherein the side surfaces each comprise a plurality of sections that are angled with respect to each other, a first one of the plurality of sections forming a laterally extending, rearwardly facing shoulder extending generally parallel to the rear surface and substantially parallel to the front surface, a second one of the plurality of sections disposed adjacent and intersecting the front surface, the shoulders extending outwardly beyond a lateral extent of the rear surface;

the bottom surface comprising at least one projection;

the bottom surface defining a channel extending from the rear surface toward the front surface, and an aperture extending into the block from the channel;

abuttingly engaging a contact edge of the projection of the first block with one of the shoulders of the second block;

inserting an end portion of an earth anchor having an aperture therethrough into the channel of the first block; and inserting a pin through the aperture of the second block, the aperture of the earth anchor, and the aperture of the first block.

18. The method of interlocking retaining wall blocks in vertically adjacent courses of claim 17, further comprising the step of abuttingly engaging the contact edge of the projection of the first block with a shoulder of a third block.

19. The method of interlocking retaining wall blocks in vertically adjacent courses of claim 17, further comprising the step of attaching geogrid to the earth anchor.

* * * * *